US008830154B2

(12) United States Patent
Wang

(10) Patent No.: US 8,830,154 B2
(45) Date of Patent: Sep. 9, 2014

(54) LIQUID CRYSTAL DISPLAY DEVICE AND DRIVING CIRCUIT WITH REDUCED NUMBER OF SCAN DRIVERS AND DATA DRIVERS

(75) Inventor: Jinjie Wang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 140 days.

(21) Appl. No.: 13/510,928

(22) PCT Filed: Apr. 18, 2012

(86) PCT No.: PCT/CN2012/074257

§ 371 (c)(1),
(2), (4) Date: May 18, 2012

(87) PCT Pub. No.: WO2013/155683

PCT Pub. Date: Oct. 24, 2013

(65) Prior Publication Data

US 2013/0271357 A1 Oct. 17, 2013

(30) Foreign Application Priority Data

Apr. 16, 2012 (CN) ..... 2012 1 0110926

(51) Int. Cl.
*G09G 3/36* (2006.01)

(52) U.S. Cl.
USPC ..... 345/92; 345/100

(58) Field of Classification Search
USPC ..... 345/87, 92, 103, 76, 82, 204, 98–100
See application file for complete search history.

(56) References Cited

U.S. PATENT DOCUMENTS

| | | | | |
|---|---|---|---|---|
| 2001/0050688 | A1* | 12/2001 | Fujiyoshi et al. | 345/600 |
| 2003/0227428 | A1* | 12/2003 | Nose | 345/90 |
| 2004/0145581 | A1* | 7/2004 | Morita | 345/204 |
| 2005/0024297 | A1* | 2/2005 | Shin | 345/76 |
| 2005/0140614 | A1* | 6/2005 | Baek | 345/87 |
| 2006/0274570 | A1* | 12/2006 | Jeoung et al. | 365/154 |
| 2009/0033641 | A1* | 2/2009 | Yamazaki | 345/204 |
| 2009/0128545 | A1* | 5/2009 | Lee et al. | 345/214 |
| 2009/0251455 | A1* | 10/2009 | Park et al. | 345/214 |
| 2010/0117939 | A1* | 5/2010 | Lee | 345/76 |
| 2012/0001950 | A1* | 1/2012 | Kim | 345/690 |

* cited by examiner

*Primary Examiner* — Chanh Nguyen
*Assistant Examiner* — Jonathan Blancha
(74) *Attorney, Agent, or Firm* — Andrew C. Cheng

(57) ABSTRACT

The present invention discloses a liquid crystal display device and its driving circuit. The first switch unit and one of the channels of the scan driver correspond to the pixel units of more than one row. The input terminal of the first switch unit is electrically connected to one of the channels, and each of the output terminals of the first switch unit is electrically connected to a scan line of the pixel units of more than one row for outputting a scan signal from one of channels of the scan driver to the pixel units electrically connected to the corresponding scan line.

7 Claims, 5 Drawing Sheets

LIQUID CRYSTAL DISPLAY DEVICE AND DRIVING CIRCUIT WITH REDUCED NUMBER OF SCAN DRIVERS AND DATA DRIVERS

BACKGROUND OF THE INVENTION

1. Field of the Invention

The present invention relates to the field of display techniques, and in particular to a liquid crystal display device and display panel.

2. The Related Arts

A liquid crystal display device usually comprises an array substrate, a color film substrate, and a liquid crystal layer disposed between the array substrate and the color film substrate. A liquid crystal display device usually comprises a plurality of pixel units. Each pixel unit comprises pixel electrode made of Indium Tin Oxide (ITO) thin-film disposed on array substrate and common electrode disposed on color film substrate. The pixel electrode and the common electrode on color film substrate form liquid crystal capacitor.

The known technologies adopt an array substrate, as shown in FIG. 1, to drive the liquid crystal display device. The array substrate comprises scan lines 101 arranged in rows, data lines 103 arranged in columns and in a manner crossing but isolated from scan lines 101, pixel electrodes 103 of a plurality of unit areas divided by scan lines 101 and data lines 103, and thin film transistor 107. Data drivers and scan drivers (not shown) are connected to data lines 103 and scan lines 101, respectively; wherein the gate terminals of thin film transistors 107 of the same row are all connected to the same nearest data line, and the drain terminal of each thin film transistors 107 is connected to pixel electrode 105 in the same unit area.

When data lines receive data signals from data drivers and scan lines receive scan signals from scan drivers to cause the change in the voltage of the pixel electrode and leading to the change of the voltage imposed on liquid crystal capacitor, the polarization direction of the liquid crystal molecule in the liquid crystal layer also changes to controls the amount of light transmitting through the liquid crystal layer, and leading to controlling the display luminance of each pixel.

However, under the known structure, a liquid crystal display device of resolution m×n requires 3m data lines and n scan lines. If the channel for data drivers and the channel for scan drivers are a and b respectively, the number of data drivers and the number of scan drivers are 3 m/a and n/b respectively. The high prices of data drivers and scan drivers increases the manufacture cost of the liquid crystal display device.

SUMMARY OF THE INVENTION

The technical issue to be addressed by the present invention is to provide a liquid crystal display device and driving circuit thereof, which can reduce the numbers of required scan drivers and data drivers for the same resolution level so as to reduce the manufacture cost.

The present invention provides a liquid crystal display device, which comprises: a first substrate, a second substrate and a liquid crystal layer disposed between the first substrate and the second substrate; wherein the first substrate comprises a plurality of pixel units arranged in a matrix form, a plurality of scan drivers, a plurality of data drivers, a plurality of first switch units and a plurality of second switch units, all arranged around the peripheral of pixel unit matrix. Each of pixel units further comprises: a data line, in row direction; a first scan line and a second scan line, in column direction;

pixel electrode, disposed in area surrounded by scan lines and data line; and a controlled switch; wherein controlled switch is a first thin film transistor. In each row of the pixel units, the gate terminal of the first thin film transistor of odd-column pixel unit is connected the first scan line, the gate terminal of the first thin film transistor of even-column pixel unit is connected the second scan line, the source terminal of the first thin film transistor is connected to the data line, and the drain terminal of the first thin film transistor is connected to the pixel electrode. Each of the first switch units and one of the channels of scan drivers correspond to the first-column pixel unit and the second-column pixel unit. Each of the first switch units comprises an input terminal, a first output terminal, a second output terminal and a third output terminal. The first output terminal of each of the first switch units is electrically connected to the first scan line of the first-column pixel unit, the second output terminal of each of the first switch units is electrically connected to the second scan line of the first-column pixel unit, and the third output terminal of each of the first switch units is electrically connected to the first scan line or the second scan line of the second-column pixel unit for selectively outputting the scan signal from one of the channels of scan driver to the odd-row or even-row pixel unit of one of the two columns of pixel unit. Each of the second switch units and one of the channels of data drivers correspond to two-row pixel unit. Each of the second switch units comprises an input terminal, a first output terminal, and a second output terminal. The input terminal of the second switch unit is electrically connected to one of the channels of the data driver. The first output terminal of each of the second switch units is electrically connected to the data line of the first-row pixel unit, the second output terminal of each of the second switch units is electrically connected to the data line of the adjacent even-row for selectively outputting the data signal from one of the channels of data driver to the odd-row or even-row pixel unit of two adjacent rows. The first switch unit comprises: a first select line, a second select line, a third select line, a fourth select line, a fifth select line, a sixth select line and a low voltage signal line, all arranged in row direction; a first driver, for outputting voltage select signal to the first select line, the second select line, the third select line, the fourth select line, the fifth select line, and the sixth select line, and outputting low voltage to low voltage signal line; a first field effect transistor, with gate terminal of the first field effect transistor electrically connected to the first select line, source terminal of the first field effect transistor electrically connected to one of the channels of the scan driver, and drain terminal of the first field effect transistor electrically connected to the first scan line of the first-column pixel unit; a second field effect transistor, with gate terminal of the second field effect transistor electrically connected to the second select line, source terminal of the first field effect transistor electrically connected to the aforementioned channel of the scan driver, and drain terminal of the second field effect transistor electrically connected to the second scan line of the first-column pixel unit; a third field effect transistor, with gate terminal of the third field effect transistor electrically connected to the third select line, source terminal of the third field effect transistor electrically connected to the aforementioned channel of the scan driver, and drain terminal of the third field effect transistor electrically connected to the first scan line or the second scan line of the second-column pixel unit; a fourth field effect transistor, with gate terminal of the fourth field effect transistor electrically connected to the fourth select line, source terminal of the fourth field effect transistor electrically connected to the low voltage signal line, and drain terminal of the fourth field effect transistor electrically connected to the first scan line scan line of the first-column pixel unit; a fifth field effect transistor, with gate terminal of the fifth field effect transistor electrically connected to the fifth select line, source terminal of the fifth field effect transistor electrically connected to the low voltage signal line, and drain terminal of the fifth field effect transistor electrically connected to the second scan line of the first-column pixel unit; a sixth field effect transistor, with gate terminal of the sixth field effect transistor electrically connected to the sixth select line, source terminal of the sixth field effect transistor electrically connected to the low voltage signal line, and drain terminal of the third field effect transistor electrically connected to the first scan line or the second scan line of the second-column pixel unit. The second switch unit comprises: a seventh select line and an eighth select line, both arranged in row direction; a second driver, for outputting voltage select signal to the seventh select line or the eighth select line; a seventh field effect transistor, with gate terminal of the seventh field effect transistor electrically connected to the seventh select line, source terminal of the seventh field effect transistor electrically connected to one of the channels of the data driver, and drain terminal of the seventh field effect transistor electrically connected to the data line of one of the odd-row data rows; an eighth field effect transistor, with gate terminal of the eighth field effect transistor electrically connected to the eighth select line, source terminal of the eighth field effect transistor electrically connected to the aforementioned channel of the data driver, and drain terminal of the eighth field effect transistor electrically connected to the data line of the adjacent even-row. When the first driver outputs a high voltage to the first select line, the fifth select line and the sixth select line, and outputs a low voltage to the second select line, the third select line, the fourth select line and low voltage signal line, the first field effect transistor, the fourth field effect transistor and the fifth field effect transistor are conductive, and the second field effect transistor, the third field effect transistor and the fourth field effect transistor are turned off so that the scan signal outputted by one of the channels of the scan driver passes through the first field effect transistor to the first scan line of the first-column pixel unit, the low voltage signal from the low voltage signal line passes through the fifth field effect transistor to the second scan line of the first-column pixel unit, and through the sixth field effect transistor to the first scan line or the second scan line of the second-column pixel unit to select supplying the scan signal to the odd-row pixel unit of the first-column pixel unit. When the second driver outputs a high voltage to the seventh select line and outputs a low voltage to the eighth select line, the seventh field effect transistor is conductive and the eighth field effect transistor is turned off so that the data signal outputted by one of the channels of the data driver passes through the seventh field effect transistor to the data line of one of the odd-row data lines to select supplying the data signal to the pixel unit of the same odd-row. When the first driver outputs a high voltage to the second select line, the fourth select line and the sixth select line, and outputs a low voltage to the first select line, the third select line, the fifth select line and low voltage signal line, the second field effect transistor, the fourth field effect transistor and the sixth field effect transistor are conductive, and the first field effect transistor, the third field effect transistor and the fifth field effect transistor are turned off so that the scan signal outputted by the aforementioned channel of the scan driver passes through the second field effect transistor to the second scan line of the first-column pixel unit, the low voltage signal from the low voltage signal line passes through the fourth field effect transistor to the first scan line of the first-column pixel unit, and through the sixth field effect transistor to the first scan line or the second scan line of the second-column pixel unit to select supplying the scan signal to the even-row pixel unit of the first-column pixel unit. When the second driver outputs a high voltage to the eighth select line and outputs a low voltage to the seventh select line, the eighth field effect transistor is conductive and the seventh field effect transistor is turned off so that the data signal outputted by the aforementioned channel of the data driver passes through the eighth field effect transistor to the data line of an adjacent even-row to select supplying the data signal to the pixel unit of the same even-row. When the first driver outputs a high voltage to the third select line, the fourth select line and the fifth select line, and outputs a low voltage to the first select line, the second select line, the sixth select line and low voltage signal line, the third field effect transistor, the fourth field effect transistor and the fifth field effect transistor are conductive, and the first field effect transistor, the second field effect transistor and the sixth field effect transistor are turned off so that the scan signal outputted by the aforementioned channel of the scan driver passes through the third field effect transistor to the first scan line or the second scan line of the second-column pixel unit, the low voltage signal from the low voltage signal line passes through the fourth field effect transistor to the first scan line of the first-column pixel unit, and through the fifth field effect transistor to the second scan line the first-column pixel unit to select supplying the scan signal to the odd-row or the even-row pixel unit of the second-column pixel unit. When the second driver outputs a high voltage to the eighth select line and outputs a low voltage to the seventh select line, the eighth field effect transistor is conductive and the seventh field effect transistor is turned off so that the data signal outputted by the aforementioned of the data driver passes through the eighth field effect transistor to the data line of an adjacent even-row to select supplying the data signal to the pixel unit of the same even-row.

The present invention provides a liquid crystal display device, which comprises: a first substrate, a second substrate and a liquid crystal layer disposed between the first substrate and the second substrate; wherein the first substrate comprises a plurality of pixel units arranged in a matrix form, a plurality of scan drivers, a plurality of data drivers, a plurality of first switch units and a plurality of second switch units, all arranged around the peripheral of pixel unit matrix. Each of pixel units further comprises: a data line, in row direction; at least two scan lines, in column direction; pixel electrode, disposed in area surrounded by scan lines and data line; and a controlled switch. In each column of the pixel units, the controlled terminal of the controlled switch is electrically connected one of the at least two scan lines, the input terminal of the controlled switch is electrically connected the data line, and the output terminal of the controlled switch is electrically connected to the pixel electrode. Each of the first switch units and one of the channels of scan driver correspond to pixel unit of more than one column. Each of the first switch units comprises an input terminal, and at least three output terminals. The input terminal of the first switch unit is electrically connected to one of the channels of scan driver, and each of the output terminals of the first switch unit is electrically connected to a corresponding scan line of a pixel unit of more than one column, for selectively outputting the scan signal from one of the channels of scan driver to the pixel unit of a corresponding scan line. Each of the second switch units and one of the channels of data driver correspond to pixel unit of at least two rows. Each of the second switch units comprises an input terminal, and at least two output terminals. Each of the output terminals of the second switch unit is electrically connected to a corresponding data line, for selectively outputting the data signal from one of the channels of data driver to the pixel unit of one row of the at least two rows of pixel units.

According to a preferred embodiment of the present invention, the controlled switch is a first thin film transistor. Each of the pixel units comprises a first scan line and a second scan line, arranged in column direction. In each column of the pixel units, the gate terminal of the first thin film transistor of odd-row pixel unit is connected to the first scan line, and the gate terminal of the first thin film transistor of even-row pixel unit is connected to the second scan line. Each of the first switch units corresponds to the adjacent first-column pixel unit and the second-column pixel unit. Each of the first switch units comprises a first output terminal, a second output terminal, a third output terminal, and a fourth output terminal. The first output terminal of each of the first switch units is electrically connected to the first scan line of the first-column pixel unit, the second output terminal of each of the first switch units is electrically connected to the second scan line of the first-column pixel unit, the third output terminal of each of the first switch units is electrically connected to the first scan line of the second-column pixel unit, and the fourth output terminal of each of the first switch units is electrically connected to the second scan line of the second-column pixel unit, for selectively outputting the scan signal from one of the channels of scan driver to the odd-row or even-row pixel unit of one of the two columns of pixel unit. Each of the second switch units comprises a first output terminal and a second output terminal. The first output terminal of each of the first second switch units is electrically connected to the data line of an odd-row pixel unit, and the second output terminal of each of the second switch units is electrically connected to the data line of the adjacent even-row for selectively outputting the data signal from one of the channels of data driver to the odd-row or even-row pixel unit of two adjacent rows. When the first switch unit selects to supply scan signal to odd-row pixel unit of the first-column pixel units, the second switch unit selects to supply data signal to odd-row pixel units. When the first switch unit selects to supply scan signal to even-row pixel unit of the first-column pixel units, the second switch unit selects to supply data signal to even-row pixel units. When the first switch unit selects to supply scan signal to odd-row pixel unit of the second-column pixel units, the second switch unit selects to supply data signal to odd-row pixel units. When the first switch unit selects to supply scan signal to even-row pixel unit of the second-column pixel units, the second switch unit selects to supply data signal to even-row pixel units.

According to a preferred embodiment of the present invention, the controlled switch is a first thin film transistor. Each of the pixel units comprises a first scan line and a second scan line, arranged in column direction. In each column of the pixel units, the gate terminal of the first thin film transistor of odd-row pixel unit is connected to the first scan line, and the gate terminal of the first thin film transistor of even-row pixel unit is connected to the second scan line. Each of the first switch units corresponds to the first-column pixel unit and the second-column pixel unit. Each of the first switch units comprises a first output terminal, a second output terminal, and a third output terminal. The first output terminal of each of the first switch units is electrically connected to the first scan line of the first-column pixel unit, the second output terminal of each of the first switch units is electrically connected to the second scan line of the first-column pixel unit, and the third output terminal of each of the first switch units is electrically connected to the first scan line or the second scan line of the second-column pixel unit, for selectively outputting the scan signal from one of the channels of scan driver to the odd-row or even-row pixel unit of one of the two columns of pixel unit. Each of the second switch units comprises a first output terminal and a second output terminal. The first output terminal of each of the second switch units is electrically connected to the data line of an odd-row pixel unit, and the second output terminal of each of the second switch units is electrically connected to the data line of the adjacent even-row for selectively outputting the data signal from one of the channels of data driver to the odd-row or even-row pixel unit of two adjacent rows. When the first switch unit selects to supply scan signal to odd-row pixel unit of the first-column pixel units, the second switch unit selects to supply data signal to odd-row pixel units. When the first switch unit selects to supply scan signal to even-row pixel unit of the first-column pixel units, the second switch unit selects to supply data signal to even-row pixel units. When the first switch unit selects to supply scan signal to odd-row or even-row pixel unit of the second-column pixel units, the second switch unit selects to supply data signal to odd-row or even-row pixel units.

According to a preferred embodiment of the present invention, the first switch unit comprises: a first select line, a second select line, a third select line, a fourth select line, a fifth select line, a sixth select line and a low voltage signal line, all arranged in row direction; a first driver, for outputting voltage select signal to the first select line, the second select line, the third select line, the fourth select line, the fifth select line, and the sixth select line, and outputting low voltage to low voltage signal line; a first field effect transistor, with gate terminal of the first field effect transistor electrically connected to the first select line, source terminal of the first field effect transistor electrically connected to one of the channels of the scan driver, and drain terminal of the first field effect transistor electrically connected to the first scan line of the first-column pixel unit; a second field effect transistor, with gate terminal of the second field effect transistor electrically connected to the second select line, source terminal of the first field effect transistor electrically connected to the aforementioned channel of the scan driver, and drain terminal of the second field effect transistor electrically connected to the second scan line of the first-column pixel unit; a third field effect transistor, with gate terminal of the third field effect transistor electrically connected to the third select line, source terminal of the third field effect transistor electrically connected to the aforementioned channel of the scan driver, and drain terminal of the third field effect transistor electrically connected to the first scan line or the second scan line of the second-column pixel unit; a fourth field effect transistor, with gate terminal of the fourth field effect transistor electrically connected to the fourth select line, source terminal of the fourth field effect transistor electrically connected to the low voltage signal line, and drain terminal of the fourth field effect transistor electrically connected to the first scan line scan line of the first-column pixel unit; a fifth field effect transistor, with gate terminal of the fifth field effect transistor electrically connected to the fifth select line, source terminal of the fifth field effect transistor electrically connected to the low voltage signal line, and drain terminal of the fifth field effect transistor electrically connected to the second scan line of the first-column pixel unit; a sixth field effect transistor, with gate terminal of the sixth field effect transistor electrically connected to the sixth select line, source terminal of the sixth field effect transistor electrically connected to the low voltage signal line, and drain terminal of the third field effect transistor electrically connected to the first scan line or the second scan line of the second-column pixel unit. When the first driver outputs a high voltage to the first select line, the fifth select line and the sixth select line, and outputs a low voltage to the second select line, the third select line, the fourth select line and low voltage signal line, the first field effect transistor, the fourth field effect transistor and the fifth field effect transistor are conductive, and the second field effect transistor, the third field effect transistor and the fourth field effect transistor are turned off so that the scan signal outputted by one of the channels of the scan driver passes through the first field effect transistor to the first scan line of the first-column pixel unit, the low voltage signal from the low voltage signal line passes through the fifth field effect transistor to the second scan line of the first-column pixel unit, and through the sixth field effect transistor to the first scan line or the second scan line of the second-column pixel unit to select supplying the scan signal to the odd-row pixel unit of the first-column pixel unit. When the first driver outputs a high voltage to the second select line, the fourth select line and the sixth select line, and outputs a low voltage to the first select line, the third select line, the fifth select line and low voltage signal line, the second field effect transistor, the fourth field effect transistor and the sixth field effect transistor are conductive, and the first field effect transistor, the third field effect transistor and the fifth field effect transistor are turned off so that the scan signal outputted by the aforementioned channel of the scan driver passes through the second field effect transistor to the second scan line of the first-column pixel unit, the low voltage signal from the low voltage signal line passes through the fourth field effect transistor to the first scan line of the first-column pixel unit, and through the sixth field effect transistor to the first scan line or the second scan line of the second-column pixel unit to select supplying the scan signal to the even-row pixel unit of the first-column pixel unit. When the first driver outputs a high voltage to the third select line, the fourth select line and the fifth select line, and outputs a low voltage to the first select line, the second select line, the sixth select line and low voltage signal line, the third field effect transistor, the fourth field effect transistor and the fifth field effect transistor are conductive, and the first field effect transistor, the second field effect transistor and the sixth field effect transistor are turned off so that the scan signal outputted by the aforementioned channel of the scan driver passes through the third field effect transistor to the first scan line or the second scan line of the second-column pixel unit, the low voltage signal from the low voltage signal line passes through the fourth field effect transistor to the first scan line of the first-column pixel unit, and through the fifth field effect transistor to the second scan line the first-column pixel unit to select supplying the scan signal to the odd-row or the even-row pixel unit of the second-column pixel unit.

According to a preferred embodiment of the present invention, the second switch unit comprises: a seventh select line and an eighth select line, both arranged in row direction; a second driver, for outputting voltage select signal to the seventh select line or the eighth select line; a seventh field effect transistor, with gate terminal of the seventh field effect transistor electrically connected to the seventh select line, source terminal of the seventh field effect transistor electrically connected to one of the channels of the data driver, and drain terminal of the seventh field effect transistor electrically connected to the data line of one of the odd-row data rows; an eighth field effect transistor, with gate terminal of the eighth field effect transistor electrically connected to the eighth select line, source terminal of the eighth field effect transistor electrically connected to the aforementioned channel of the data driver, and drain terminal of the second field effect transistor electrically connected to the data line of the adjacent even-row. When the second driver outputs a high voltage to the seventh select line and outputs a low voltage to the eighth select line, the seventh field effect transistor is conductive and the eighth field effect transistor is turned off so that the data signal outputted by one of the channels of the data driver passes through the seventh field effect transistor to the data line of one of the odd-row data lines to select supplying the data signal to the pixel unit of the same odd-row. When the second driver outputs a high voltage to the eighth select line and outputs a low voltage to the seventh select line, the eighth field effect transistor is conductive and the seventh field effect transistor is turned off so that the data signal outputted by the aforementioned channel of the data driver passes through the eighth field effect transistor to the data line of an adjacent even-row to select supplying the data signal to the pixel unit of the same even-row.

The present invention provides a driving circuit for liquid crystal display, which comprises: a plurality of scan drivers, a plurality of data drivers, a plurality of first switch units and a plurality of second switch units, all arranged around the peripheral of a pixel unit matrix formed by a plurality of pixel units of liquid crystal display. Each of pixel units further comprises: a data line, in row direction; at least two scan lines, in column direction; pixel electrode, disposed in area surrounded by scan lines and data line; and a controlled switch. In each column of the pixel units, the controlled terminal of the controlled switch of is electrically connected to one of the at least two scan lines, the input terminal of the controlled switch is electrically connected to the data line, and the output terminal of the controlled switch is electrically connected to the pixel electrode. Each of the first switch units and one of the channels of scan drivers correspond to pixel unit of more than one column. Each of the first switch units comprises an input terminal, and at least three output terminals. The input terminal of the first switch unit is electrically connected to one of the channels of scan driver, and each of the output terminals of the first switch unit is electrically connected to a corresponding scan line of a pixel unit of more than one column, for selectively outputting the scan signal from one of the channels of scan driver to the pixel unit of a corresponding scan line. Each of the second switch units and one of the channels of data drivers correspond to pixel unit of at least two rows. Each of the second switch units comprises an input terminal, and at least two output terminals. Each of the output terminals of the second switch unit is electrically connected to a corresponding data line, for selectively outputting the data signal from one of the channels of data driver to the pixel unit of one row of the at least two rows of pixel units.

According to a preferred embodiment of the present invention, the controlled switch is a first thin film transistor. Each of the pixel units comprises a first scan line and a second scan line, arranged in column direction. In each column of the pixel units, the gate terminal of the first thin film transistor of odd-row pixel unit is connected to the first scan line, and the gate terminal of the first thin film transistor of even-row pixel unit is connected to the second scan line. Each of the first switch units corresponds to the adjacent first-column pixel unit and the second-column pixel unit. Each of the first switch units comprises a first output terminal, a second output terminal, a third output terminal, and a fourth output terminal. The first output terminal of each of the first switch units is electrically connected to the first scan line of the first-column pixel unit, the second output terminal of each of the first switch units is electrically connected to the second scan line of the first-column pixel unit, the third output terminal of each of the first switch units is electrically connected to the first scan line of the second-column pixel unit, and the fourth output terminal of each of the first switch units is electrically connected to the second scan line of the second-column pixel unit, for selectively outputting the scan signal from one of the channels of scan driver to the odd-row or even-row pixel unit of one of the two columns of pixel unit. Each of the second switch units comprises a first output terminal and a second output terminal. The first output terminal of each of the first second switch units is electrically connected to the data line of an odd-row pixel unit, and the second output terminal of each of the second switch units is electrically connected to the data line of the adjacent even-row for selectively outputting the data signal from one of the channels of data driver to the odd-row or even-row pixel unit of two adjacent rows. When the first switch unit selects to supply scan signal to odd-row pixel unit of the first-column pixel units, the second switch unit selects to supply data signal to odd-row pixel units. When the first switch unit selects to supply scan signal to even-row pixel unit of the first-column pixel units, the second switch unit selects to supply data signal to even-row pixel units. When the first switch unit selects to supply scan signal to odd-row pixel unit of the second-column pixel units, the second switch unit selects to supply data signal to odd-row pixel units. When the first switch unit selects to supply scan signal to even-row pixel unit of the second-column pixel units, the second switch unit selects to supply data signal to even-row pixel units.

According to a preferred embodiment of the present invention, the controlled switch is a first thin film transistor. Each of the pixel units comprises a first scan line and a second scan line, arranged in column direction. In each column of the pixel units, the gate terminal of the first thin film transistor of odd-row pixel unit is connected to the first scan line, and the gate terminal of the first thin film transistor of even-row pixel unit is connected to the second scan line. Each of the first switch units corresponds to the first-column pixel unit and the second-column pixel unit. Each of the first switch units comprises a first output terminal, a second output terminal, and a third output terminal. The first output terminal of each of the first switch units is electrically connected to the first scan line of the first-column pixel unit, the second output terminal of each of the first switch units is electrically connected to the second scan line of the first-column pixel unit, and the third output terminal of each of the first switch units is electrically connected to the first scan line or the second scan line of the second-column pixel unit, for selectively outputting the scan signal from one of the channels of scan driver to the odd-row or even-row pixel unit of one of the two columns of pixel unit. Each of the second switch units comprises a first output terminal and a second output terminal. The first output terminal of each of the second switch units is electrically connected to the data line of an odd-row pixel unit, and the second output terminal of each of the second switch units is electrically connected to the data line of the adjacent even-row for selectively outputting the data signal from one of the channels of data driver to the odd-row or even-row pixel unit of two adjacent rows. When the first switch unit selects to supply scan signal to odd-row pixel unit of the first-column pixel units, the second switch unit selects to supply data signal to odd-row pixel units. When the first switch unit selects to supply scan signal to even-row pixel unit of the first-column pixel units, the second switch unit selects to supply data signal to even-row pixel units. When the first switch unit selects to supply scan signal to odd-row or even-row pixel unit of the second-column pixel units, the second switch unit selects to supply data signal to odd-row or even-row pixel units.

According to a preferred embodiment of the present invention, the first switch unit comprises: a first select line, a second select line, a third select line, a fourth select line, a fifth select line, a sixth select line and a low voltage signal line, all arranged in row direction; a first driver, for outputting voltage select signal to the first select line, the second select line, the third select line, the fourth select line, the fifth select line, and the sixth select line, and outputting low voltage to low voltage signal line; a first field effect transistor, with gate terminal of the first field effect transistor electrically connected to the first select line, source terminal of the first field effect transistor electrically connected to one of the channels of the scan driver, and drain terminal of the first field effect transistor electrically connected to the first scan line of the first-column pixel unit; a second field effect transistor, with gate terminal of the second field effect transistor electrically connected to the second select line, source terminal of the first field effect transistor electrically connected to the aforementioned channel of the scan driver, and drain terminal of the second field effect transistor electrically connected to the second scan line of the first-column pixel unit; a third field effect transistor, with gate terminal of the third field effect transistor electrically connected to the third select line, source terminal of the third field effect transistor electrically connected to the aforementioned channel of the scan driver, and drain terminal of the third field effect transistor electrically connected to the first scan line or the second scan line of the second-column pixel unit; a fourth field effect transistor, with gate terminal of the fourth field effect transistor electrically connected to the fourth select line, source terminal of the fourth field effect transistor electrically connected to the low voltage signal line, and drain terminal of the fourth field effect transistor electrically connected to the first scan line scan line of the first-column pixel unit; a fifth field effect transistor, with gate terminal of the fifth field effect transistor electrically connected to the fifth select line, source terminal of the fifth field effect transistor electrically connected to the low voltage signal line, and drain terminal of the fifth field effect transistor electrically connected to the second scan line of the first-column pixel unit; a sixth field effect transistor, with gate terminal of the sixth field effect transistor electrically connected to the sixth select line, source terminal of the sixth field effect transistor electrically connected to the low voltage signal line, and drain terminal of the third field effect transistor electrically connected to the first scan line or the second scan line of the second-column pixel unit. When the first driver outputs a high voltage to the first select line, the fifth select line and the sixth select line, and outputs a low voltage to the second select line, the third select line, the fourth select line and low voltage signal line, the first field effect transistor, the fourth field effect transistor and the fifth field effect transistor are conductive, and the second field effect transistor, the third field effect transistor and the fourth field effect transistor are turned off so that the scan signal outputted by one of the channels of the scan driver passes through the first field effect transistor to the first scan line of the first-column pixel unit, the low voltage signal from the low voltage signal line passes through the fifth field effect transistor to the second scan line of the first-column pixel unit, and through the sixth field effect transistor to the first scan line or the second scan line of the second-column pixel unit to select supplying the scan signal to the odd-row pixel unit of the first-column pixel unit. When the first driver outputs a high voltage to the second select line, the fourth select line and the sixth select line, and outputs a low voltage to the first select line, the third select line, the fifth select line and low voltage signal line, the second field effect transistor, the fourth field effect transistor and the sixth field effect transistor are conductive, and the first field effect transistor, the third field effect transistor and the fifth field effect transistor are turned off so that the scan signal outputted by the aforementioned channel of the scan driver passes through the second field effect transistor to the second scan line of the first-column pixel unit, the low voltage signal from the low voltage signal line passes through the fourth field effect transistor to the first scan line of the first-column pixel unit, and through the sixth field effect transistor to the first scan line or the second scan line of the second-column pixel unit to select supplying the scan signal to the even-row pixel unit of the first-column pixel unit. When the first driver outputs a high voltage to the third select line, the fourth select line and the fifth select line, and outputs a low voltage to the first select line, the second select line, the sixth select line and low voltage signal line, the third field effect transistor, the fourth field effect transistor and the fifth field effect transistor are conductive, and the first field effect transistor, the second field effect transistor and the sixth field effect transistor are turned off so that the scan signal outputted by the aforementioned channel of the scan driver passes through the third field effect transistor to the first scan line or the second scan line of the second-column pixel unit, the low voltage signal from the low voltage signal line passes through the fourth field effect transistor to the first scan line of the first-column pixel unit, and through the fifth field effect transistor to the second scan line the first-column pixel unit to select supplying the scan signal to the odd-row or the even-row pixel unit of the second-column pixel unit.

According to a preferred embodiment of the present invention, the second switch unit comprises: a seventh select line and an eighth select line, both arranged in row direction; a second driver, for outputting voltage select signal to the seventh select line or the eighth select line; a seventh field effect transistor, with gate terminal of the seventh field effect transistor electrically connected to the seventh select line, source terminal of the seventh field effect transistor electrically connected to one of the channels of the data driver, and drain terminal of the seventh field effect transistor electrically connected to the data line of one of the odd-row data rows; an eighth field effect transistor, with gate terminal of the eighth field effect transistor electrically connected to the eighth select line, source terminal of the eighth field effect transistor electrically connected to the aforementioned channel of the data driver, and drain terminal of the second field effect transistor electrically connected to the data line of the adjacent even-row. When the second driver outputs a high voltage to the seventh select line and outputs a low voltage to the eighth select line, the seventh field effect transistor is conductive and the eighth field effect transistor is turned off so that the data signal outputted by one of the channels of the data driver passes through the seventh field effect transistor to the data line of one of the odd-row data lines to select supplying the data signal to the pixel unit of the same odd-row. When the second driver outputs a high voltage to the eighth select line and outputs a low voltage to the seventh select line, the eighth field effect transistor is conductive and the seventh field effect transistor is turned off so that the data signal outputted by the aforementioned channel of the data driver passes through the eighth field effect transistor to the data line of an adjacent even-row to select supplying the data signal to the pixel unit of the same even-row.

The efficacy of the present invention is that to be distinguished from the state of the art. The liquid crystal display device according to the present invention comprises a first switch nit and a second switch unit, so that the first switch unit can drive more than one row of pixel units in time-sharing manner to realize a plurality of scan lines sharing a channel of the scan driver to reduce the number of required scan drivers and reduce the manufacture cost. At the same time, by driving the pixel units of the same column in time-sharing manner, the present invention uses the control of second switch units to realize a plurality of data lines sharing a channel of the data driver to reduce the number of required data drivers to further reduce the manufacture cost.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The figures and the embodiments are referred to in following detailed description.

Figure 1:
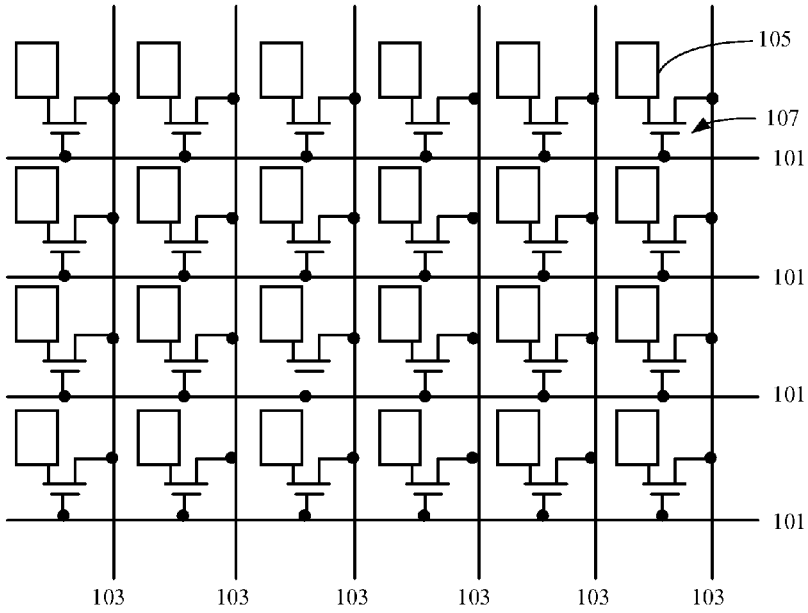
FIG 1 ( Prior Art )
FIG. 1 is a schematic view showing the structure of a known array substrate.
Figure 2:
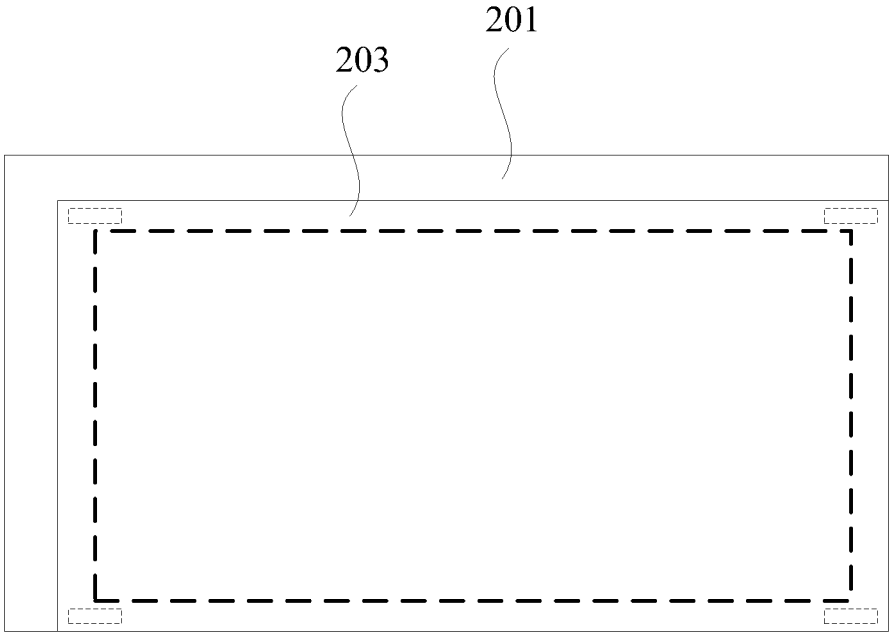
FIG. 2 is a front view of a first embodiment of a liquid crystal display device according to the present invention.
Figure 3:
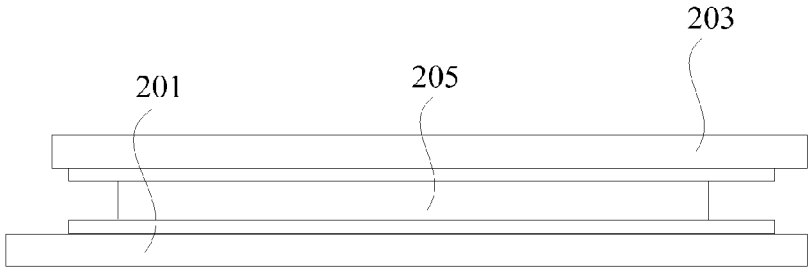
FIG. 3 is a side view of the liquid crystal display device of FIG. 2.

Refer to FIG. 2 and FIG. 3. FIG. 2 is a front view of a first embodiment of a liquid crystal display device according to the present invention, and FIG. 3 is a side view of the liquid crystal display device of FIG. 2. The first embodiment of the liquid crystal display device of the present invention comprises a first substrate 201, a second substrate 202 and a liquid crystal layer 205 sandwiched between first substrate 201 and second substrate 202, wherein first substrate 201 is an array substrate and second substrate 203 is a color film substrate.

Figure 4:
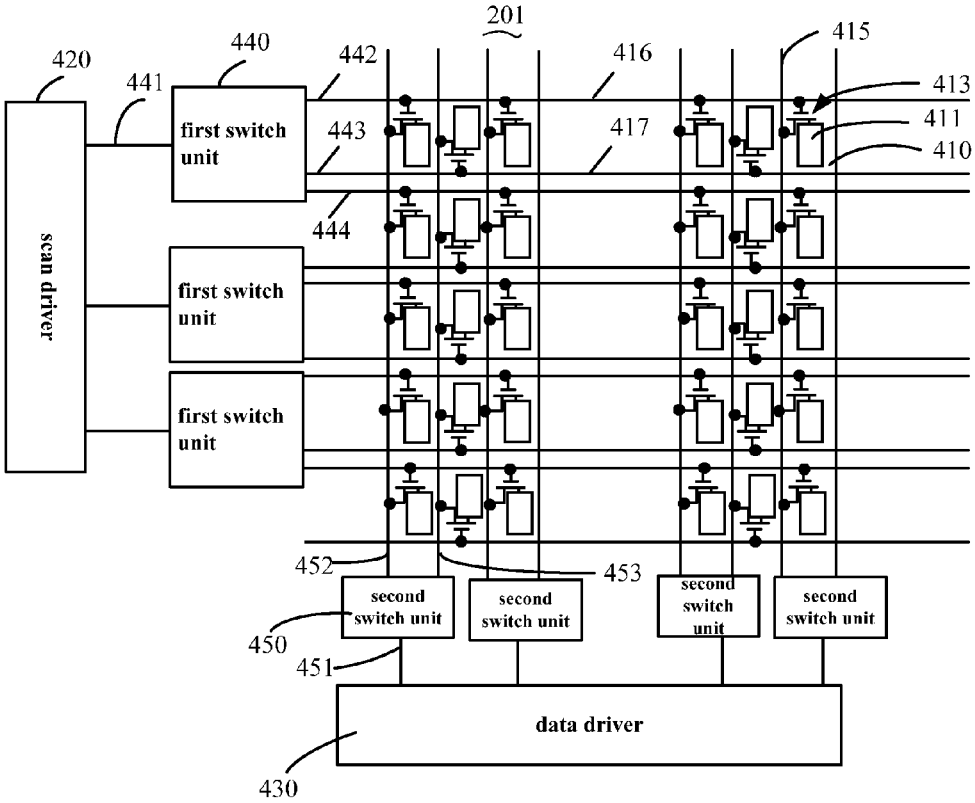
FIG. 4 is a circuit diagram of a first embodiment of the driving circuit for liquid crystal display device on the first substrate of FIG. 2.

Refer to FIG. 4 with FIGS. 2-3. FIG. 4 is a circuit diagram of a first embodiment of the driving circuit for liquid crystal display device on the first substrate of FIG. 2. In the present embodiment, first substrate 201 comprises a plurality of pixel units 410 arranged in a matrix form, and a plurality of scan drivers 420, a plurality of data drivers 430, a plurality of first switch units 440 and a plurality of second switch units 450, all disposed in the peripheral areas of pixel units 410.

Each of pixel units 410 comprises a data line 415, in row direction; a first scan line 416 and a second scan line 417, in column direction to cross over but isolated from data line 415; a pixel electrode 411, disposed in the area formed by data line 415, first scan line 416 and second scan line 417; and a first thin film transistor 413. It is worth noting that first scan line 416 and second scan line 417 of each of pixel units 410 are connected to corresponding lines of other pixel units to form a complete conductive line.

Pixel electrode 411 is disposed in the area formed by data line 415, first scan line 416 and second scan line 417.

First thin film transistor 413 is also disposed in the area formed by data line 415, first scan line 416 and second scan line 417. In each column of pixel units 410, the gate terminal of first thin film transistor 413 of odd-row pixel unit is electrically connected to first scan line 416, and the gate terminal of first thin film transistor 413 of even-row pixel unit is electrically connected to second scan line 417. The source terminal of every first thin film transistor 413 is electrically connected to data line 415, and the drain terminal of every first thin film transistor 413 is electrically connected to pixel electrode 411.

Each of first switch units 440 and one of the channels of scan driver 420 are corresponding to pixel units 410 of more than one row, for selectively outputting the scan signal from one of the channels of scan driver 420 to either odd-row or even-row pixel unit 410 of the same column. Each of the first switch units 440 comprises an input terminal 441, a first output terminal 442, a second output terminal 443 and a third output terminal 444. Input terminal 441 of first switch unit 410 is electrically connected to one of the channels of scan driver 420. First output terminal 442 of first switch unit 440 is electrically connected to first scan line 416 of the first-column pixel unit, second output terminal 443 of first switch unit 440 is electrically connected to second scan line 417 of the first-column pixel unit, and third output terminal 444 of first switch unit 440 is electrically connected to first scan line 416 of the adjacent second-column pixel unit.

Each of second switch units 450 and one of the channels of data driver 430 correspond to two rows of pixel units 410, for selectively outputting the data signal from one of the channels of data driver 430 to the odd-row or even-row pixel unit 410 of two adjacent rows. Each of second switch units 450 comprises an input terminal 451, a first output terminal 452, and a second output terminal 453. Input terminal 451 of second switch unit 450 is electrically connected to one of the channels of data driver 430. First output terminal 452 of second switch unit 450 is electrically connected to data line 415 of the odd-row pixel unit, and second output terminal 452 of second switch unit 450 is electrically connected to data line 415 of the even-row pixel unit adjacent to the odd-row pixel unit.

According to the present embodiment, each of first switch units 440 and one of the channels of scan driver 420 correspond to pixel units 410 of more than one row. In other words, a plurality of first switch units 440 shares a scan driver 420. Each of second switch units 450 and one of the channels of data driver 430 correspond to two rows of pixel units 410. In other words, a plurality of second switch units 450 shares a data driver 430. Also, two rows of pixel units 410 shares one channel of data driver 430 through a second switch unit 450.

It is worth noting that FIG. 4 only shows a scan driver 420 and a data driver 430. In actual application, the number of scan drivers 420 and the number of data drivers 430 can vary according to the actual requirement.

It is also worth noting that the use of first thin film transistor 413 in the above embodiment is only illustrative instead of restrictive, and can be replaced by a triode, a Darlington transistor, or any other controlled switch for the same effect.

First switch unit 440 is not only selectively outputting the scan signal from one of the channels of scan driver 420 to either odd-row or even-row pixel unit 410 of the same column based on the even-number or odd-number rules. In other embodiments, the rule for selection can be random, or other rules. For example, first switch unit 440 comprises four output terminals, and three of the output terminals are connected to the three scan lines of the pixels of the same column, and the remaining output terminal is connected to the scan line of the pixel units of the adjacent column.

Through the disposition of first switch unit 440 and second switch unit 450, the present embodiment can drive more than one column of pixel units in a time-sharing manner to realize a plurality of scan lines sharing the same channel of the scan driver to reduce the number of required scan drivers and reduce the manufacture cost. At the same time, by dividing the pixel units of a column into odd-row and even-row to drive, and to realize the reuse of the channel of data driver 430 and save at least a half of the channels to reduce the number of required data drivers 430 and reduce the manufacture cost.

Figure 5:
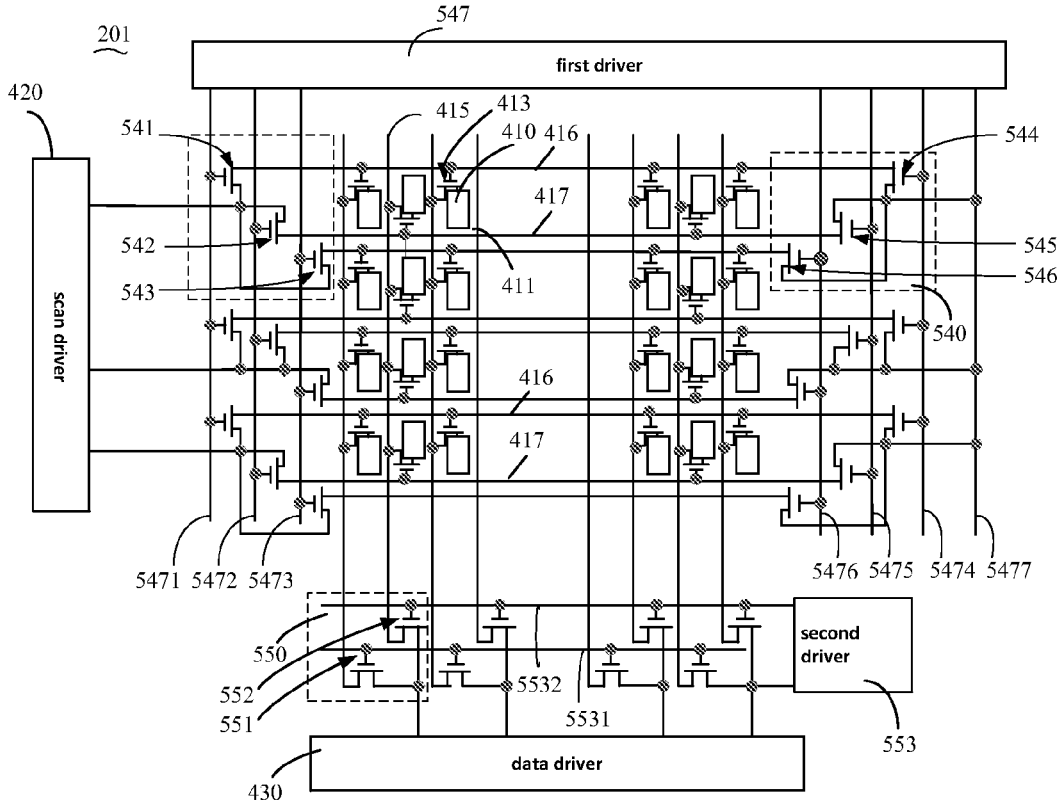
FIG. 5 is a circuit diagram of the driving circuit for liquid crystal display device on the first substrate of FIG. 4.

Refer to FIG. 5. FIG. 5 is a circuit diagram of the driving circuit for liquid crystal display device on the first substrate of FIG. 4.

The difference between the present embodiment and the first embodiment of FIG. 4 is the following:

Each of first switch units 540 comprises: a first select line 5471, a second select line 5472, a third select line 5473, a fourth select line 5474, a fifth select line 5475, a sixth select line 5476, a low voltage signal line 5477, a first driver 547, a first field effect transistor 541, a second field effect transistor 542, a third field effect transistor 543, a fourth field effect transistor 544, a fifth field effect transistor 545, and a sixth field effect transistor 546.

First select line 5471, second select line 5472, third select line 5473, fourth select line 5474, fifth select line 5475, sixth select line 5476, and low voltage signal line 5477 are all disposed in row direction on first substrate 201.

First driver 547 is electrically connected respectively to first select line 5471, second select line 5472, third select line 5473, fourth select line 5474, fifth select line 5475, sixth select line 5476, and low voltage signal line 5477. First driver 547 is for outputting voltage selection signal to first select line 5471, second select line 5472, third select line 5473, fourth select line 5474, fifth select line 5475, sixth select line 5476, and low voltage signal line 5477.

The gate terminal of first field effect transistor 541 is electrically connected to first select line 5471, source terminal of first field effect transistor 541 is electrically connected to one of the channels of scan driver 420, and drain terminal of first field effect transistor 541 is electrically connected to first scan line 416 of the first-column pixel unit.

The gate terminal of second field effect transistor 542 is electrically connected to second select line 5472, source terminal of second field effect transistor 542 is electrically connected to the aforementioned channel of scan driver 420, and drain terminal of second field effect transistor 542 is electrically connected to second scan line 417 of the first-column pixel unit.

The gate terminal of third field effect transistor 543 is electrically connected to third select line 5473, source terminal of third field effect transistor 543 is electrically connected to the aforementioned channel of scan driver 420, and drain terminal of third field effect transistor 543 is electrically connected to first scan line 416 of the second-column pixel unit. In another embodiment, the drain terminal of third field effect transistor 543 can also be electrically connected to second scan line 417 of the second-column pixel unit.

The gate terminal of fourth field effect transistor 544 is electrically connected to fourth select line 5474, source terminal of fourth field effect transistor 544 is electrically connected to low voltage signal line 5477, and drain terminal of fourth field effect transistor 544 is electrically connected to first scan line 416 of the first-column pixel unit.

The gate terminal of fifth field effect transistor 545 is electrically connected to fifth select line 5475, source terminal of fifth field effect transistor 545 is electrically connected to low voltage signal line 5477, and drain terminal of fifth field effect transistor 545 is electrically connected to second scan line 417 of the first-column pixel unit.

The gate terminal of sixth field effect transistor 546 is electrically connected to sixth select line 5476, source terminal of sixth field effect transistor 546 is electrically connected to low voltage signal line 5477, and drain terminal of sixth field effect transistor 546 is electrically connected to first scan line 416 of the second-column pixel unit. In another embodiment, the drain terminal of sixth field effect transistor 546 can also be electrically connected to second scan line 417 of the second-column pixel unit.

Each of second switch units 550 comprises: a seventh select line 5531, an eighth select line 5532, a second driver 553, a seventh field effect transistor 551 and an eighth field effect transistor 552.

Seventh select line 5531 and eighth select line 5532 are disposed transversely on first substrate 201.

Second driver 533 is electrically connected to seventh select line 5531 and eighth select line 5532, respectively. Second driver 533 is for outputting voltage signal to seventh select line 5531 and eighth select line 5532, respectively.

The gate terminal of seventh field effect transistor 551 is electrically connected to seventh select line 5531, source terminal of seventh field effect transistor 551 is electrically connected to one of the channels of data driver 430, and drain terminal of seventh field effect transistor 551 is electrically connected to data line 415 of one of the odd-row data rows.

The gate terminal of eighth field effect transistor 552 is electrically connected to eighth select line 5532, source terminal of eighth field effect transistor 552 is electrically connected to the aforementioned channel of data driver 430, and drain terminal of eight field effect transistor 552 is electrically connected to data line 415 of the adjacent even-row.

The actual embodiment of the aforementioned driving circuit and driving method of the present invention is:

Refer to FIG. 4. In this embodiment, the liquid crystal display device uses column scan manner. Therefore, for scanning each frame, for example, from the first column, first switch unit 440 selects to supply scan signal to pixel units 410 of the odd-row of the first column, and all second switch units 450 simultaneously select to supply data signal to pixel units 410 of odd-row. When first switch unit 440 selects to supply scan signal to pixel units 410 of the even-row of the first column, and all second switch units 450 simultaneously select to supply data signal to pixel units 410 of even-row adjacent to the odd-row. When first switch unit 440 selects to supply scan signal to pixel units 410 of the odd-row of the second column, and all second switch units 450 simultaneously select to supply data signal to pixel units 410 of odd-row, and so on, until finishing scanning the last column to complete the scan and data registration of a frame.

Refer to FIG. 5. For the specific situation of a channel of data driver 430, when first driver 547 outputs a high voltage to first select line 5471, fifth select line 5475 and sixth select line 5476, and outputs a low voltage to second select line 5472, third select line 5473, fourth select line 5474 and low voltage signal line 5477, first field effect transistor 541, fourth field effect transistor 544 and fifth field effect transistor 545 are conductive, and second field effect transistor 542, third field effect transistor 543 and fourth field effect transistor 544 are turned off so that the scan signal outputted by one of the channels of scan driver 420 passes through first field effect transistor 541 to first scan line 416 of the first-column pixel unit, the low voltage signal from low voltage signal line 5477 passes through fifth field effect transistor 545 to second scan line 417 of the first-column pixel unit, and through sixth field effect transistor 546 to first scan line 416 or second scan line 417 of the second-column pixel unit to select supplying the scan signal to the odd-row pixel unit of the first-column pixel unit.

Then, when second driver 553 outputs a high voltage to seventh select line 5531 and outputs a low voltage to eighth select line 5532, seventh field effect transistor 551 is conductive and eighth field effect transistor 552 is turned off so that the data signal outputted by one of the channels of data driver 430 passes through seventh field effect transistor 551 to data line 415 of one of the odd-row data lines to select supplying the data signal to the pixel unit of the same odd-row.

When first driver 547 outputs a high voltage to second select line 5472, fourth select line 5474 and sixth select line 5476, and outputs a low voltage to first select line 5471, third select line 5473, fifth select line 5475 and low voltage signal line 5477, second field effect transistor 542, fourth field effect transistor 544 and sixth field effect transistor 546 are conductive, and first field effect transistor 541, third field effect transistor 543 and fifth field effect transistor 545 are turned off so that the scan signal outputted by the aforementioned channel of scan driver 420 passes through second field effect transistor 542 to second scan line 417 of the first-column pixel unit, the low voltage signal from low voltage signal line 5477 passes through fourth field effect transistor 544 to first scan line 416 of the first-column pixel unit, and through sixth field effect transistor 546 to first scan line 416 or second scan line 417 of the second-column pixel unit to select supplying the scan signal to the even-row pixel unit of the first-column pixel unit.

Then, when second driver 533 outputs a high voltage to eighth select line 5532 and outputs a low voltage to seventh select line 5531, eighth field effect transistor 552 is conductive and seventh field effect transistor 551 is turned off so that the data signal outputted by the aforementioned channel of data driver 430 passes through eighth field effect transistor 552 to data line 415 of an adjacent even-row to select supplying the data signal to the pixel unit of the same even-row.

When first driver 547 outputs a high voltage to third select line 5473, fourth select line 5474 and fifth select line 5475, and outputs a low voltage to first select line 5471, second select line 5472, sixth select line 5476 and low voltage signal line 5477, third field effect transistor 543, fourth field effect transistor 544 and fifth field effect transistor 545 are conductive, and first field effect transistor 541, second field effect transistor 542 and sixth field effect transistor 546 are turned off so that the scan signal outputted by the aforementioned channel of scan driver 420 passes through third field effect transistor 543 to first scan line 416 or second scan line 417 of the second-column pixel unit, the low voltage signal from low voltage signal line 5477 passes through fourth field effect transistor 544 to first scan line 416 of the first-column pixel unit, and through fifth field effect transistor 545 to second scan line 417 of the first-column pixel unit to select supplying the scan signal to the odd-row or the even-row pixel unit of the second-column pixel unit.

Then, when second driver 553 outputs a high voltage to seventh select line 5531 and outputs a low voltage to eighth select line 5532, seventh field effect transistor 551 is conductive and eighth field effect transistor 552 is turned off so that the data signal outputted by the aforementioned channel of data driver 430 passes through seventh field effect transistor 551 to data line 415 of one of the odd-row data lines to select supplying the data signal to the pixel unit of the same odd-row.

The above describes the specific situations of a channel of data driver 430. The remaining channels of data driver 430 and all the channels of other data drivers 430 operate in the same manner simultaneously.

In other words, when scanning each column, the first step is for the first switch unit 440 to select to supply scan signal to pixel units 410 of the odd-row of the first column. Then, all second switch units 450 simultaneously select to supply data signal to pixel units 410 of odd-row. Then, when the first switch unit 440 selects to supply scan signal to pixel units 410 of the even-row of the first column, and then all second switch units 450 simultaneously select to supply data signal to pixel units 410 of even-row. Then, when the first switch unit 440 selects to supply scan signal to pixel units 410 of the odd-row of the second column, and then all second switch units 450 simultaneously select to supply data signal to pixel units 410 of odd-row, and so on, until finishing scanning the last column to complete the scan and data registration of a frame.

It is worth noting that when a first switch unit 440 corresponds to more columns of pixel units, the driving method is similar to the above description, and will not be repeated here.

Figure 6:
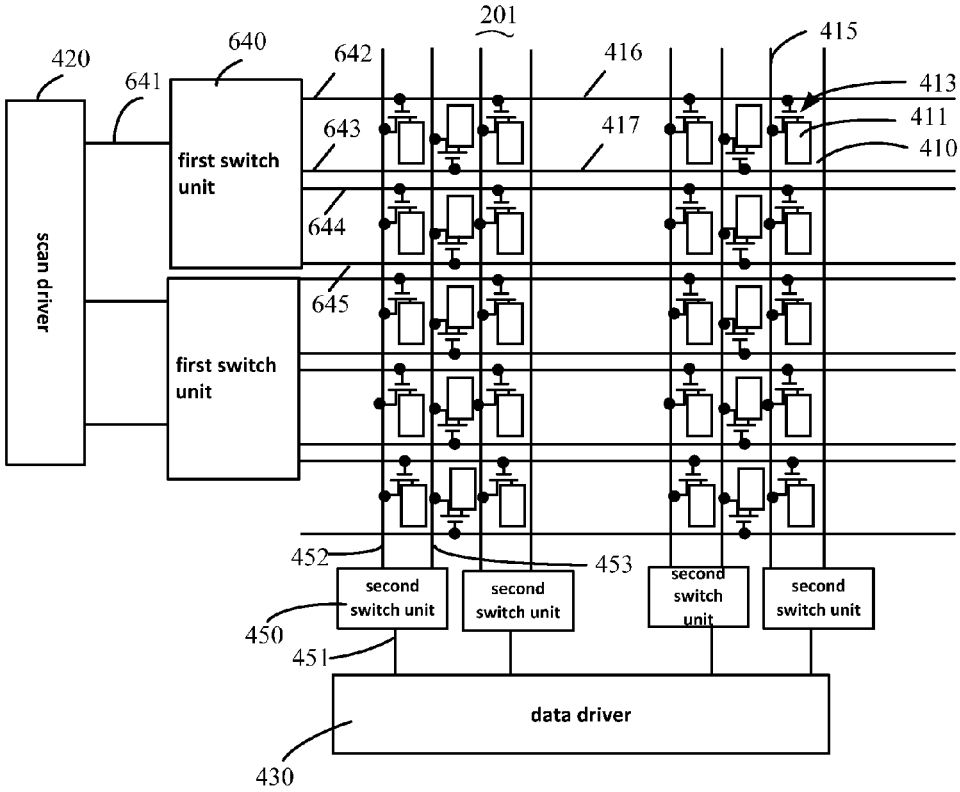
FIG. 6 is a circuit diagram of a second embodiment of the driving circuit for liquid crystal display device on the first substrate of FIG. 2.

Refer to FIG. 6. FIG. 6 is a circuit diagram of a second embodiment of the driving circuit for liquid crystal display device on the first substrate of FIG. 2. The difference between this embodiment and the first embodiment of FIG. 4 is:

Each of first switch units 640 corresponds to the pixels of adjacent first row and second row.

Each of first switch units 640 comprises an input terminal 641, a first output terminal 642, a second output terminal 643, a third output terminal 644, and a fourth output terminal 645.

The input terminal of first switch unit 640 is electrically connected to one of the channels of scan driver 420. First output terminal 642 of first switch unit 640 is electrically connected to first scan line 416 of the first-column pixel unit, second output terminal 643 of first switch unit 640 is electrically connected to second scan line 417 of the first-column pixel unit, third output terminal 644 of first switch unit 640 is electrically connected to first scan line 416 of the second-column pixel unit, and fourth output terminal 645 of first switch unit 640 is electrically connected to second scan line 417 of the second-column pixel unit, for selectively outputting the scan signal from one of the channels of scan driver 420 to the odd-row or even-row pixel unit of one of the two columns of pixel unit.

It is worth noting that first switch unit 640 in the above embodiment can also correspond to more columns of pixel units. Accordingly, first switch unit 640 comprises the same number of output terminals as the number of scan lines of more rows of pixel units to further realize the reuse of the scan driver channel to save at least a half of the channels and reduce the manufacture cost.

In addition, it is noted that the specific structures of first switch unit 440 and second switch unit 450 are not restricted to the described form. Those who are skilled in this field cam realize equivalent function or structure to first switch unit 440 and second switch unit 450. The efficacy of the present invention is that to be distinguished from the state of the art. The liquid crystal display device according to the present invention comprises a first switch nit and a second switch unit, so that the first switch unit can drive more than one row of pixel units in time-sharing manner to realize a plurality of scan lines sharing a channel of the scan driver to reduce the number of required scan drivers and reduce the manufacture cost. At the same time, by driving the pixel units of the same column in time-sharing manner, the present invention uses the control of second switch units to realize a plurality of data lines sharing a channel of the data driver to reduce the number of required data drivers to further reduce the manufacture cost.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A liquid crystal display device, which comprises: a first substrate, a second substrate disposed opposite to the first substrate, and a liquid crystal layer disposed between the first substrate and the second substrate, wherein:

the first substrate further comprises a plurality of pixel units arranged in a matrix form, a plurality of scan drivers, a plurality of data drivers, a plurality of first switch units and a plurality of second switch units, all arranged around peripheral of pixel unit matrix;

wherein each of pixel units further comprises: a data line, arranged in row direction; a first scan line and a second scan line, arranged in column direction; pixel electrode, disposed in area surrounded by the scan lines and the data line; and a controlled switch; wherein the controlled switch is a first thin film transistor; in each row of the pixel units, gate terminal of the first thin film transistor of odd-column pixel unit is connected the first scan line, gate terminal of the first thin film transistor of even-column pixel unit is connected the second scan line, source terminal of the first thin film transistor is connected to the data line, and drain terminal of the first thin film transistor is connected to the pixel electrode;

each of the first switch units and one of channels of scan drivers correspond to the first-column pixel unit and the second-column pixel unit; and each of the first switch units further comprises an input terminal, a first output terminal, a second output terminal and a third output terminal; the first output terminal of the first switch unit is electrically connected to the first scan line of the first-column pixel unit, the second output terminal of the first switch unit is electrically connected to the second scan line of the first-column pixel unit, and the third output terminal of the first switch unit is electrically connected to the first scan line or the second scan line of the second-column pixel unit for selectively outputting the scan signal from one of channels of scan driver to either odd-row or even-row pixel units of one of two columns of pixel units;

each of the second switch units and one of channels of data driver correspond to two row of pixel units; each of the second switch units comprises an input terminal, a first output terminal, and a second output terminal; the input terminal of the second switch unit is electrically connected to one of channels of the data driver; the first output terminal of the second switch unit is electrically connected to the data line of the first-row pixel unit; the second output terminal of the second switch unit is electrically connected to the data line of adjacent even-row for selectively outputting data signal from one of channels of data driver to the odd-row or even-row pixel unit of two adjacent rows;

wherein the first switch unit further comprises:

a first select line, a second select line, a third select line, a fourth select line, a fifth select line, a sixth select line and a low voltage signal line, all arranged in row direction;

a first driver, for outputting a voltage select signal to the first select line, the second select line, the third select line, the fourth select line, the fifth select line, and the sixth select line, and outputting a low voltage to the low voltage signal line;

a first field effect transistor, with gate terminal of the first field effect transistor electrically connected to the first select line, source terminal of the first field effect transistor electrically connected to one of channels of the scan driver, and drain terminal of the first field effect transistor electrically connected to the first scan line of the first-column pixel unit;

a second field effect transistor, with gate terminal of the second field effect transistor electrically connected to the second select line, source terminal of the first field effect transistor electrically connected to the said channel of the scan driver, and drain terminal of the second field effect transistor electrically connected to the second scan line of the first-column pixel unit;

a third field effect transistor, with gate terminal of the third field effect transistor electrically connected to the third select line, source terminal of the third field effect transistor electrically connected to the said channel of the scan driver, and drain terminal of the third field effect transistor electrically connected to the first scan line or the second scan line of the second-column pixel unit;

a fourth field effect transistor, with gate terminal of the fourth field effect transistor electrically connected to the fourth select line, source terminal of the fourth field effect transistor electrically connected to the low voltage signal line, and drain terminal of the fourth field effect transistor electrically connected to the first scan line scan line of the first-column pixel unit;

a fifth field effect transistor, with gate terminal of the fifth field effect transistor electrically connected to the fifth select line, source terminal of the fifth field effect transistor electrically connected to the low voltage signal line, and drain terminal of the fifth field effect transistor electrically connected to the second scan line of the first-column pixel unit;

a sixth field effect transistor, with gate terminal of the sixth field effect transistor electrically connected to the sixth select line, source terminal of the sixth field effect transistor electrically connected to the low voltage signal line, and drain terminal of the third field effect transistor electrically connected to the first scan line or the second scan line of the second-column pixel unit;

wherein the second switch unit further comprises:

a seventh select line and an eighth select line, both arranged in row direction;

a second driver, for outputting a voltage select signal to the seventh select line or the eighth select line;

a seventh field effect transistor, with gate terminal of the seventh field effect transistor electrically connected to the seventh select line, source terminal of the seventh field effect transistor electrically connected to one of channels of the data driver, and drain terminal of the seventh field effect transistor electrically connected to the data line of one of odd-row data rows;

an eighth field effect transistor, with gate terminal of the eighth field effect transistor electrically connected to the eighth select line, source terminal of the eighth field effect transistor electrically connected to the said channel of the data driver, and drain terminal of the eighth field effect transistor electrically connected to the data line of adjacent even-row;

wherein when the first driver outputs a high voltage to the first select line, the fifth select line and the sixth select line, and outputs a low voltage to the second select line, the third select line, the fourth select line and the low voltage signal line, the first field effect transistor, the fourth field effect transistor and the fifth field effect transistor are conductive, and the second field effect transistor, the third field effect transistor and the fourth field effect transistor are turned off so that scan signal outputted by one of channels of scan driver passes through the first field effect transistor to the first scan line of the first-column pixel unit, low voltage signal from the low voltage signal line passes through the fifth field effect transistor to the second scan line of the first-column pixel unit, and through the sixth field effect transistor to the first scan line or the second scan line of the second-column pixel unit to select supplying the scan signal to the odd-row pixel unit of the first-column pixel unit;

when the second driver outputs a high voltage to the seventh select line and outputs a low voltage to the eighth select line, the seventh field effect transistor is conductive and the eighth field effect transistor is turned off so that the data signal outputted by one of channels of data driver passes through the seventh field effect transistor to the data line of one of odd-row data lines to select supplying the data signal to pixel unit of same odd-row;

when the first driver outputs a high voltage to the second select line, the fourth select line and the sixth select line, and outputs a low voltage to the first select line, the third select line, the fifth select line and the low voltage signal line, the second field effect transistor, the fourth field effect transistor and the sixth field effect transistor are conductive, and the first field effect transistor, the third field effect transistor and the fifth field effect transistor are turned off so that scan signal outputted by the said channel of scan driver passes through the second field effect transistor to the second scan line of the first-column pixel unit, low voltage signal from the low voltage signal line passes through the fourth field effect transistor to the first scan line of the first-column pixel unit, and through the sixth field effect transistor to the first scan line or the second scan line of the second-column pixel unit to select supplying the scan signal to the even-row pixel unit of the first-column pixel unit;

when the second driver outputs a high voltage to the eighth select line and outputs a low voltage to the seventh select line, the eighth field effect transistor is conductive and the seventh field effect transistor is turned off so that data signal outputted by the said channel of the data driver passes through the eighth field effect transistor to the data line of an adjacent even-row to select supplying the data signal to the pixel unit of same even-row;

when the first driver outputs a high voltage to the third select line, the fourth select line and the fifth select line, and outputs a low voltage to the first select line, the second select line, the sixth select line and the low voltage signal line, the third field effect transistor, the fourth field effect transistor and the fifth field effect transistor are conductive, and the first field effect transistor, the second field effect transistor and the sixth field effect transistor are turned off so that scan signal outputted by the said channel of the scan driver passes through the third field effect transistor to the first scan line or the second scan line of the second-column pixel unit, low voltage signal from the low voltage signal line passes through the fourth field effect transistor to the first scan line of the first-column pixel unit, and through the fifth field effect transistor to the second scan line the first-column pixel unit to select supplying the scan signal to the odd-row or the even-row pixel unit of the second-column pixel unit;

when the second driver outputs a high voltage to the eighth select line and outputs a low voltage to the seventh select line, the eighth field effect transistor is conductive and the seventh field effect transistor is turned off so that data signal outputted by the said channel of the data driver passes through the eighth field effect transistor to the data line of an adjacent even-row to select supplying the data signal to the pixel unit of same even-row.

2. A liquid crystal display device, which comprises: a first substrate, a second substrate disposed opposite to the first substrate, and a liquid crystal layer disposed between the first substrate and the second substrate, wherein:

the first substrate further comprises a plurality of pixel units arranged in a matrix form, a plurality of scan drivers, a plurality of data drivers, a plurality of first switch units and a plurality of second switch units, all arranged around peripheral of pixel unit matrix;

each of pixel units further comprises: a data line, arranged in row direction; at least two scan lines, arranged in column direction; a pixel electrode, disposed in area surrounded by the scan lines and the data line; and a controlled switch; in each column of the pixel units, controlled terminal of the controlled switch is electrically connected one of the at least two scan lines, input terminal of the controlled switch is electrically connected the data line, and output terminal of the controlled switch is electrically connected to the pixel electrode;

each of the first switch units and one of channels of scan driver corresponding to pixel unit of more than one column; each of the first switch units further comprises: an input terminal, and at least three output terminals; the input terminal of the first switch unit is electrically connected to one of channels of scan driver, and each of the output terminals of the first switch unit is electrically connected to a corresponding scan line of a pixel unit of more than one column, for selectively outputting scan signal from one of channels of scan driver to pixel unit of a corresponding scan line;

each of the second switch units and one of channels of data driver corresponding to pixel unit of at least two rows; each of the second switch units further comprises: an input terminal, and at least two output terminals; each of the output terminals of the second switch unit is electrically connected to a corresponding data line, for selectively outputting data signal from one of channels of data driver to pixel unit of one row of the at least two rows of pixel units;

wherein:

the controlled switch is a first thin film transistor;

each of the pixel units further comprises: a first scan line and a second scan line, arranged in column direction; in each column of the pixel units, gate terminal of the first thin film transistor of odd-row pixel unit is connected to the first scan line, and gate terminal of the first thin film transistor of even-row pixel unit is connected to the second scan line;

each of the first switch units corresponds to first-column pixel unit and second-column pixel unit; each of the first switch units further comprises a first output terminal, a second output terminal, and a third output terminal; the first output terminal of each of the first switch units is electrically connected to the first scan line of the first-column pixel unit, the second output terminal of each of the first switch units is electrically connected to the second scan line of the first-column pixel unit, and the third output terminal of each of the first switch units is electrically connected to the first scan line or the second scan line of the second-column pixel unit, for selectively outputting scan signal from one of channels of scan driver to odd-row or even-row pixel unit of one of the two columns of pixel unit;

each of the second switch units further comprises: a first output terminal and a second output terminal; the first output terminal of each of the second switch units is electrically connected to the data line of an odd-row pixel unit, and the second output terminal of each of the second switch units is electrically connected to the data line of adjacent even-row for selectively outputting data signal from one of channels of data driver to odd-row or even-row pixel unit of two adjacent rows;

when the first switch unit selects to supply scan signal to odd-row pixel unit of the first-column pixel units, the second switch unit selects to supply data signal to odd-row pixel units; when the first switch unit selects to supply scan signal to even-row pixel unit of the first-column pixel units, the second switch unit selects to supply data signal to even-row pixel units; when the first switch unit selects to supply scan signal to odd-row or even-row pixel unit of the second-column pixel units, the second switch unit selects to supply data signal to odd-row or even-row pixel units;

wherein:

the first switch unit further comprises: a first select line, a second select line, a third select line, a fourth select line, a fifth select line, a sixth select line and a low voltage signal line, all arranged in row direction;

a first driver, for outputting a voltage select signal to the first select line, the second select line, the third select line, the fourth select line, the fifth select line, and the sixth select line, and outputting a low voltage to the low voltage signal line;

a first field effect transistor, with gate terminal of the first field effect transistor electrically connected to the first select line, source terminal of the first field effect transistor electrically connected to one of channels of scan driver, and drain terminal of the first field effect transistor electrically connected to the first scan line of the first-column pixel unit;

a second field effect transistor, with gate terminal of the second field effect transistor electrically connected to the second select line, source terminal of the first field effect transistor electrically connected to the said channel of the scan driver, and drain terminal of the second field effect transistor electrically connected to the second scan line of the first-column pixel unit;

a third field effect transistor, with gate terminal of the third field effect transistor electrically connected to the third select line, source terminal of the third field effect transistor electrically connected to the said channel of the scan driver, and drain terminal of the third field effect transistor electrically connected to the first scan line or the second scan line of the second-column pixel unit;

a fourth field effect transistor, with gate terminal of the fourth field effect transistor electrically connected to the fourth select line, source terminal of the fourth field effect transistor electrically connected to the low voltage signal line, and drain terminal of the fourth field effect transistor electrically connected to the first scan line scan line of the first-column pixel unit;

a fifth field effect transistor, with gate terminal of the fifth field effect transistor electrically connected to the fifth select line, source terminal of the fifth field effect transistor electrically connected to the low voltage signal line, and drain terminal of the fifth field effect transistor electrically connected to the second scan line of the first-column pixel unit;

a sixth field effect transistor, with gate terminal of the sixth field effect transistor electrically connected to the sixth select line, source terminal of the sixth field effect transistor electrically connected to the low voltage signal line, and drain terminal of the third field effect transistor electrically connected to the first scan line or the second scan line of the second-column pixel unit;

when the first driver outputs a high voltage to the first select line, the fifth select line and the sixth select line, and outputs a low voltage to the second select line, the third select line, the fourth select line and the low voltage signal line, the first field effect transistor, the fourth field effect transistor and the fifth field effect transistor are conductive, and the second field effect transistor, the third field effect transistor and the fourth field effect transistor are turned off so that scan signal outputted by one of channels of the scan driver passes through the first field effect transistor to the first scan line of the first-column pixel unit, low voltage signal from the low voltage signal line passes through the fifth field effect transistor to the second scan line of the first-column pixel unit, and through the sixth field effect transistor to the first scan line or the second scan line of the second-column pixel unit to select supplying the scan signal to the odd-row pixel unit of the first-column pixel unit;

when the first driver outputs a high voltage to the second select line, the fourth select line and the sixth select line, and outputs a low voltage to the first select line, the third select line, the fifth select line and the low voltage signal line, the second field effect transistor, the fourth field effect transistor and the sixth field effect transistor are conductive, and the first field effect transistor, the third field effect transistor and the fifth field effect transistor are turned off so that scan signal outputted by the said channel of the scan driver passes through the second field effect transistor to the second scan line of the first-column pixel unit, low voltage signal from the low voltage signal line passes through the fourth field effect transistor to the first scan line of the first-column pixel unit, and through the sixth field effect transistor to the first scan line or the second scan line of the second-column pixel unit to select supplying the scan signal to the even-row pixel unit of the first-column pixel unit;

when the first driver outputs a high voltage to the third select line, the fourth select line and the fifth select line, and outputs a low voltage to the first select line, the second select line, the sixth select line and the low voltage signal line, the third field effect transistor, the fourth field effect transistor and the fifth field effect transistor are conductive, and the first field effect transistor, the second field effect transistor and the sixth field effect transistor are turned off so that scan signal outputted by the said channel of the scan driver passes through the third field effect transistor to the first scan line or the second scan line of the second-column pixel unit, low voltage signal from the low voltage signal line passes through the fourth field effect transistor to the first scan line of the first-column pixel unit, and through the fifth field effect transistor to the second scan line the first-column pixel unit to select supplying the scan signal to the odd-row or the even-row pixel unit of the second-column pixel unit.

3. The liquid crystal display device as claimed in claim 2, wherein:

the controlled switch is a first thin film transistor;

each of the pixel units further comprises: a first scan line and a second scan line, arranged in column direction; in each column of the pixel units, gate terminal of the first thin film transistor of odd-row pixel unit is connected to the first scan line, and gate terminal of the first thin film transistor of even-row pixel unit is connected to the second scan line;

each of the first switch units corresponds to adjacent first-column pixel unit and second-column pixel unit; each of the first switch units comprises a first output terminal, a second output terminal, a third output terminal, and a fourth output terminal; the first output terminal of each of the first switch units is electrically connected to the first scan line of the first-column pixel unit, the second output terminal of each of the first switch units is electrically connected to the second scan line of the first-column pixel unit, the third output terminal of each of the first switch units is electrically connected to the first scan line of the second-column pixel unit, and the fourth output terminal of each of the first switch units is electrically connected to the second scan line of the second-column pixel unit, for selectively outputting scan signal from one of channels of scan driver to odd-row or even-row pixel unit of one of the two columns of pixel unit;

each of the second switch units further comprises: a first output terminal and a second output terminal; the first output terminal of each of the first second switch units is electrically connected to the data line of an odd-row pixel unit, and the second output terminal of each of the second switch units is electrically connected to the data line of adjacent even-row for selectively outputting data signal from one of channels of data driver to odd-row or even-row pixel unit of two adjacent rows;

when the first switch unit selects to supply scan signal to odd-row pixel unit of the first-column pixel units, the second switch unit selects to supply data signal to odd-row pixel units; when the first switch unit selects to supply scan signal to even-row pixel unit of the first-column pixel units, the second switch unit selects to supply data signal to even-row pixel units; when the first switch unit selects to supply scan signal to odd-row pixel unit of the second-column pixel units, the second switch unit selects to supply data signal to odd-row pixel units; when the first switch unit selects to supply scan signal to even-row pixel unit of the second-column pixel units, the second switch unit selects to supply data signal to even-row pixel units.

4. The liquid crystal display device as claimed in claim 2, wherein:

the second switch unit further comprises: a seventh select line and an eighth select line, both arranged in row direction;

a second driver, for outputting voltage select signal to the seventh select line or the eighth select line;

a seventh field effect transistor, with gate terminal of the seventh field effect transistor electrically connected to the seventh select line, source terminal of the seventh field effect transistor electrically connected to one of channels of the data driver, and drain terminal of the seventh field effect transistor electrically connected to the data line of one of the odd-row data rows;

an eighth field effect transistor, with gate terminal of the eighth field effect transistor electrically connected to the eighth select line, source terminal of the eighth field effect transistor electrically connected to the said channel of the data driver, and drain terminal of the second field effect transistor electrically connected to the data line of adjacent even-row;

wherein when the second driver outputs a high voltage to the seventh select line and outputs a low voltage to the eighth select line, the seventh field effect transistor is conductive and the eighth field effect transistor is turned off so that data signal outputted by one of channels of the data driver passes through the seventh field effect transistor to the data line of one of the odd-row data lines to select supplying the data signal to the pixel unit of the same odd-row;

when the second driver outputs a high voltage to the eighth select line and outputs a low voltage to the seventh select line, the eighth field effect transistor is conductive and the seventh field effect transistor is turned off so that data signal outputted by the said channel of the data driver passes through the eighth field effect transistor to the data line of an adjacent even-row to select supplying the data signal to the pixel unit of same even-row.

5. A driving circuit for liquid crystal display device, which comprises: a plurality of pixel units arranged in a matrix form, a plurality of scan drivers, a plurality of data drivers, a plurality of first switch units and a plurality of second switch units, all arranged around peripheral of pixel unit matrix of liquid crystal display;

each of pixel units further comprises: a data line, arranged in row direction; at least two scan lines, arranged in column direction; a pixel electrode, disposed in area surrounded by the scan lines and the data line; and a controlled switch; in each column of the pixel units, controlled terminal of the controlled switch is electrically connected one of the at least two scan lines, input terminal of the controlled switch is electrically connected the data line, and output terminal of the controlled switch is electrically connected to the pixel electrode;

each of the first switch units and one of channels of scan driver corresponding to pixel unit of more than one column; each of the first switch units further comprises: an input terminal, and at least three output terminals; the input terminal of the first switch unit is electrically connected to one of channels of scan driver, and each of the output terminals of the first switch unit is electrically connected to a corresponding scan line of a pixel unit of more than one column, for selectively outputting scan signal from one of channels of scan driver to pixel unit of a corresponding scan line;

each of the second switch units and one of channels of data driver corresponding to pixel unit of at least two rows; each of the second switch units further comprises: an input terminal, and at least two output terminals; each of the output terminals of the second switch unit is electrically connected to a corresponding data line, for selectively outputting data signal from one of channels of data driver to pixel unit of one row of the at least two rows of pixel units;

wherein:

the controlled switch is a first thin film transistor;

each of the pixel units further comprises: a first scan line and a second scan line, arranged in column direction; in each column of the pixel units, gate terminal of the first thin film transistor of odd-row pixel unit is connected to the first scan line, and gate terminal of the first thin film transistor of even-row pixel unit is connected to the second scan line;

each of the first switch units corresponds to first-column pixel unit and second-column pixel unit; each of the first switch units further comprises a first output terminal, a second output terminal, and a third output terminal; the first output terminal of each of the first switch units is electrically connected to the first scan line of the first-column pixel unit, the second output terminal of each of the first switch units is electrically connected to the second scan line of the first-column pixel unit, and the third output terminal of each of the first switch units is electrically connected to the first scan line or the second scan line of the second-column pixel unit, for selectively outputting scan signal from one of channels of scan driver to odd-row or even-row pixel unit of one of the two columns of pixel unit;

each of the second switch units further comprises: a first output terminal and a second output terminal; the first output terminal of each of the second switch units is electrically connected to the data line of an odd-row pixel unit, and the second output terminal of each of the second switch units is electrically connected to the data line of adjacent even-row for selectively outputting data signal from one of channels of data driver to odd-row or even-row pixel unit of two adjacent rows;

when the first switch unit selects to supply scan signal to odd-row pixel unit of the first-column pixel units, the second switch unit selects to supply data signal to odd-row pixel units; when the first switch unit selects to supply scan signal to even-row pixel unit of the first-column pixel units, the second switch unit selects to supply data signal to even-row pixel units; when the first switch unit selects to supply scan signal to odd-row or even-row pixel unit of the second-column pixel units, the second switch unit selects to supply data signal to odd-row or even-row pixel units;

wherein:

the first switch unit further comprises: a first select line, a second select line, a third select line, a fourth select line, a fifth select line, a sixth select line and a low voltage signal line, all arranged in row direction;

a first driver, for outputting a voltage select signal to the first select line, the second select line, the third select line, the fourth select line, the fifth select line, and the sixth select line, and outputting a low voltage to the low voltage signal line;

a first field effect transistor, with gate terminal of the first field effect transistor electrically connected to the first select line, source terminal of the first field effect transistor electrically connected to one of channels of scan driver, and drain terminal of the first field effect transistor electrically connected to the first scan line of the first-column pixel unit;

a second field effect transistor, with gate terminal of the second field effect transistor electrically connected to the second select line, source terminal of the first field effect transistor electrically connected to the said channel of the scan driver, and drain terminal of the second field effect transistor electrically connected to the second scan line of the first-column pixel unit;

a third field effect transistor, with gate terminal of the third field effect transistor electrically connected to the third select line, source terminal of the third field effect transistor electrically connected to the said channel of the scan driver, and drain terminal of the third field effect transistor electrically connected to the first scan line or the second scan line of the second-column pixel unit;

a fourth field effect transistor, with gate terminal of the fourth field effect transistor electrically connected to the fourth select line, source terminal of the fourth field effect transistor electrically connected to the low voltage signal line, and drain terminal of the fourth field effect transistor electrically connected to the first scan line scan line of the first-column pixel unit;

a fifth field effect transistor, with gate terminal of the fifth field effect transistor electrically connected to the fifth select line, source terminal of the fifth field effect transistor electrically connected to the low voltage signal line, and drain terminal of the fifth field effect transistor electrically connected to the second scan line of the first-column pixel unit;

a sixth field effect transistor, with gate terminal of the sixth field effect transistor electrically connected to the sixth select line, source terminal of the sixth field effect transistor electrically connected to the low voltage signal line, and drain terminal of the third field effect transistor electrically connected to the first scan line or the second scan line of the second-column pixel unit;

when the first driver outputs a high voltage to the first select line, the fifth select line and the sixth select line, and outputs a low voltage to the second select line, the third select line, the fourth select line and the low voltage signal line, the first field effect transistor, the fourth field effect transistor and the fifth field effect transistor are conductive, and the second field effect transistor, the third field effect transistor and the fourth field effect transistor are turned off so that scan signal outputted by one of channels of the scan driver passes through the first field effect transistor to the first scan line of the first-column pixel unit, low voltage signal from the low voltage signal line passes through the fifth field effect transistor to the second scan line of the first-column pixel unit, and through the sixth field effect transistor to the first scan line or the second scan line of the second-column pixel unit to select supplying the scan signal to the odd-row pixel unit of the first-column pixel unit;

when the first driver outputs a high voltage to the second select line, the fourth select line and the sixth select line, and outputs a low voltage to the first select line, the third select line, the fifth select line and the low voltage signal line, the second field effect transistor, the fourth field effect transistor and the sixth field effect transistor are conductive, and the first field effect transistor, the third field effect transistor and the fifth field effect transistor are turned off so that scan signal outputted by the said channel of the scan driver passes through the second field effect transistor to the second scan line of the first-column pixel unit, low voltage signal from the low voltage signal line passes through the fourth field effect transistor to the first scan line of the first-column pixel unit, and through the sixth field effect transistor to the first scan line or the second scan line of the second-column pixel unit to select supplying the scan signal to the even-row pixel unit of the first-column pixel unit;

when the first driver outputs a high voltage to the third select line, the fourth select line and the fifth select line, and outputs a low voltage to the first select line, the second select line, the sixth select line and the low voltage signal line, the third field effect transistor, the fourth field effect transistor and the fifth field effect transistor are conductive, and the first field effect transistor, the second field effect transistor and the sixth field effect transistor are turned off so that scan signal outputted by the said channel of the scan driver passes through the third field effect transistor to the first scan line or the second scan line of the second-column pixel unit, low voltage signal from the low voltage signal line passes through the fourth field effect transistor to the first scan line of the first-column pixel unit, and through the fifth field effect transistor to the second scan line the first-column pixel unit to select supplying the scan signal to the odd-row or the even-row pixel unit of the second-column pixel unit.

6. The driving circuit as claimed in claim 5, wherein:

the controlled switch is a first thin film transistor;

each of the pixel units further comprises: a first scan line and a second scan line, arranged in column direction; in each column of the pixel units, gate terminal of the first thin film transistor of odd-row pixel unit is connected to the first scan line, and gate terminal of the first thin film transistor of even-row pixel unit is connected to the second scan line;

each of the first switch units corresponds to adjacent first-column pixel unit and second-column pixel unit; each of the first switch units comprises a first output terminal, a second output terminal, a third output terminal, and a fourth output terminal; the first output terminal of each of the first switch units is electrically connected to the first scan line of the first-column pixel unit, the second output terminal of each of the first switch units is electrically connected to the second scan line of the first-column pixel unit, the third output terminal of each of the first switch units is electrically connected to the first scan line of the second-column pixel unit, and the fourth output terminal of each of the first switch units is electrically connected to the second scan line of the second-column pixel unit, for selectively outputting scan signal from one of channels of scan driver to odd-row or even-row pixel unit of one of the two columns of pixel unit;

each of the second switch units further comprises: a first output terminal and a second output terminal; the first output terminal of each of the second switch units is electrically connected to the data line of an odd-row pixel unit, and the second output terminal of each of the second switch units is electrically connected to the data line of adjacent even-row for selectively outputting data signal from one of channels of data driver to odd-row or even-row pixel unit of two adjacent rows;

when the first switch unit selects to supply scan signal to odd-row pixel unit of the first-column pixel units, the second switch unit selects to supply data signal to odd-row pixel units; when the first switch unit selects to supply scan signal to even-row pixel unit of the first-column pixel units, the second switch unit selects to supply data signal to even-row pixel units; when the first switch unit selects to supply scan signal to odd-row pixel unit of the second-column pixel units, the second switch unit selects to supply data signal to odd-row pixel units; when the first switch unit selects to supply scan signal to even-row pixel unit of the second-column pixel units, the second switch unit selects to supply data signal to even-row pixel units.

7. The driving circuit as claimed in claim 5, wherein:

the second switch unit further comprises: a seventh select line and an eighth select line, both arranged in row direction;

a second driver, for outputting voltage select signal to the seventh select line or the eighth select line;

a seventh field effect transistor, with gate terminal of the seventh field effect transistor electrically connected to the seventh select line, source terminal of the seventh field effect transistor electrically connected to one of channels of the data driver, and drain terminal of the seventh field effect transistor electrically connected to the data line of one of the odd-row data rows;

an eighth field effect transistor, with gate terminal of the eighth field effect transistor electrically connected to the eighth select line, source terminal of the eighth field effect transistor electrically connected to the said channel of the data driver, and drain terminal of the second field effect transistor electrically connected to the data line of adjacent even-row;

wherein when the second driver outputs a high voltage to the seventh select line and outputs a low voltage to the eighth select line, the seventh field effect transistor is conductive and the eighth field effect transistor is turned off so that data signal outputted by one of channels of the data driver passes through the seventh field effect transistor to the data line of one of the odd-row data lines to select supplying the data signal to the pixel unit of the same odd-row;

when the second driver outputs a high voltage to the eighth select line and outputs a low voltage to the seventh select line, the eighth field effect transistor is conductive and the seventh field effect transistor is turned off so that data signal outputted by the said channel of the data driver passes through the eighth field effect transistor to the data line of an adjacent even-row to select supplying the data signal to the pixel unit of same even-row.

* * * * *